US010415895B2

(12) United States Patent
Onda et al.

(10) Patent No.: US 10,415,895 B2
(45) Date of Patent: Sep. 17, 2019

(54) HEATSINK

(71) Applicant: ABL IP Holding LLC, Decatur, GA (US)

(72) Inventors: Joseph J. Onda, Lawrenceville, GA (US); Benjamin Marshall Suttles, Stockbridge, GA (US)

(73) Assignee: ABL IP Holding LLC, Atlanta, GA (US)

( * ) Notice: Subject to any disclaimer, the term of this patent is extended or adjusted under 35 U.S.C. 154(b) by 134 days.

(21) Appl. No.: 15/357,794

(22) Filed: Nov. 21, 2016

(65) Prior Publication Data

US 2018/0142965 A1 May 24, 2018

(51) Int. Cl.

| | |
|---|---|
| ***F28F 7/00*** | (2006.01) |
| ***F28F 3/02*** | (2006.01) |
| ***F28D 21/00*** | (2006.01) |
| ***F28F 3/04*** | (2006.01) |
| ***F28F 21/08*** | (2006.01) |
| ***F21V 29/81*** | (2015.01) |

(52) U.S. Cl.

CPC ..... *F28F 3/022* (2013.01); *F21V 29/81* (2015.01); *F28D 21/00* (2013.01); *F28F 3/04* (2013.01); *F28F 21/084* (2013.01); *F28D 2021/0029* (2013.01); *F28F 2215/04* (2013.01)

(58) Field of Classification Search

CPC .. F28F 3/022; F28F 21/084; F28F 3/04; F28F 2215/04; F28D 21/00; F28D 2021/0029; F21V 29/81

USPC ..... 165/80.3

See application file for complete search history.

(56) References Cited

U.S. PATENT DOCUMENTS 4,541,004 A * 9/1985 Moore ..... H01L 23/3677 257/706
4,694,223 A 9/1987 Campolo
4,823,869 A * 4/1989 Arnold ..... H01L 23/3677 165/185
5,158,136 A * 10/1992 Azar ..... F28F 1/124 165/185
5,299,090 A * 3/1994 Brady ..... H01L 23/3677 165/185
5,369,301 A * 11/1994 Hayashi ..... H01L 21/4882 165/80.3

(Continued)

FOREIGN PATENT DOCUMENTS

CN 200972859 Y 11/2007

OTHER PUBLICATIONS

Notice of Allowance for U.S. Appl. No. 29/585,186, dated Dec. 19, 2017, 11 pages.

(Continued)

*Primary Examiner* — Claire E Rojohn, III

(74) *Attorney, Agent, or Firm* — Kilpatrick Townsend & Stockton LLP

(57) ABSTRACT

A heat sink comprising pin fins extending from a base plate of the heatsink. Some of the pin fins are angled outwardly towards an outer edge of the base plate such that the tips of some of the pin fins may extend beyond the outer edge of the base plate. The distance the outer pin fins extend beyond the outer edge of the base plate can correspond to a maximum diameter of the heatsink. The maximum diameter of the heatsink can be greater than the diameter of the base plate of the heatsink.

16 Claims, 13 Drawing Sheets

(56) References Cited

U.S. PATENT DOCUMENTS 5,498,297 A * 3/1996 O'Neill ..... H01L 31/052 136/246
5,529,115 A * 6/1996 Paterson ..... F28D 15/02 165/104.21
5,726,495 A * 3/1998 Aihara ..... H01L 21/4878 165/80.3
5,763,950 A * 6/1998 Fujisaki ..... H01L 23/3672 165/80.3
5,773,886 A * 6/1998 Rostoker ..... F28F 3/02 165/80.3
D398,295 S 9/1998 Chang
5,803,161 A * 9/1998 Wahle ..... F28D 15/0233 165/104.21
5,860,472 A * 1/1999 Batchelder ..... F28F 3/02 165/185
6,003,586 A * 12/1999 Beane ..... B22D 18/06 164/63
D426,196 S 6/2000 Lee
D426,814 S 6/2000 Lee
6,295,202 B1 * 9/2001 Tucker ..... G06F 1/20 165/185
6,308,771 B1 * 10/2001 Tavassoli ..... F28F 3/02 165/80.3
6,390,181 B1 * 5/2002 Hall ..... H01L 23/3732 165/185
6,397,926 B1 * 6/2002 Sato ..... H01L 23/367 165/80.3
6,533,028 B2 * 3/2003 Sato ..... H01L 23/3677 165/185
6,543,521 B1 * 4/2003 Sato ..... H01L 23/367 165/80.3
6,591,897 B1 * 7/2003 Bhatti ..... H01L 23/3677 165/185
D490,383 S 5/2004 Tan et al.
6,807,059 B1 * 10/2004 Dale ..... H01L 21/4882 165/185
6,838,834 B2 1/2005 Okawa
6,845,010 B2 * 1/2005 Lee ..... H01L 23/3672 165/104.33
6,942,025 B2 * 9/2005 Nair ..... F28F 3/04 165/185
7,040,388 B1 * 5/2006 Sato ..... F28F 3/04 165/121
7,075,201 B2 * 7/2006 Takahashi ..... H01L 23/3672 257/E23.103
7,085,134 B2 * 8/2006 Foster, Sr. ..... H01L 23/467 165/80.3
7,150,312 B2 * 12/2006 Parish, IV ..... F28D 15/0233 165/104.21
7,274,571 B2 * 9/2007 Wei ..... H05K 7/1461 165/104.26
7,382,615 B2 * 6/2008 Long ..... H01L 23/4093 165/121
7,391,615 B2 * 6/2008 Fu ..... H01L 23/4093 165/185
7,408,777 B2 * 8/2008 Jeong ..... H05K 7/20963 165/104.33
7,515,420 B2 * 4/2009 Wayman ..... H05K 7/20418 165/104.33
7,539,017 B2 * 5/2009 Chang ..... H01L 23/3677 361/703
7,593,230 B2 * 9/2009 Abul-Haj ..... F28F 3/02 361/702
7,635,953 B2 12/2009 Tumula et al.
7,644,753 B2 * 1/2010 Ghosh ..... F28D 15/0233 165/104.26
7,646,608 B2 * 1/2010 Thompson ..... H01L 23/433 165/185
7,712,926 B2 * 5/2010 Matheson ..... F21S 2/005 362/294
D618,629 S * 6/2010 Blumenfeld ..... D13/179
7,746,652 B2 * 6/2010 Horng ..... H01L 23/4093 165/80.3
7,878,686 B2 * 2/2011 Suehiro ..... F21K 9/00 362/294
D634,280 S 3/2011 Chua et al.
D634,281 S * 3/2011 Chua ..... D13/179
7,988,301 B2 * 8/2011 Kavanagh ..... G03B 21/16 353/57
D662,898 S 7/2012 Petroski
8,262,256 B2 9/2012 Biebl et al.
8,277,109 B2 * 10/2012 Ko ..... F21V 29/75 362/249.02
8,362,677 B1 * 1/2013 Morejon ..... F21V 29/004 313/46
8,534,874 B2 * 9/2013 Hayashi ..... G02F 1/133385 165/80.3
8,695,687 B2 * 4/2014 Paschkewitz ..... B21C 37/08 165/104.21
8,740,421 B2 * 6/2014 Ramirez ..... F21V 19/0035 362/373
8,962,306 B2 * 2/2015 Cohen ..... B01L 7/52 435/287.2
D731,447 S 6/2015 Ward et al.
9,088,194 B2 * 7/2015 Tang ..... H02K 11/33
9,730,309 B2 * 8/2017 Dohn ..... H01L 23/3677
D800,676 S 10/2017 Onda et al.
D800,677 S 10/2017 Onda et al.
D803,663 S * 11/2017 Zou ..... D8/349
D822,626 S * 7/2018 Reilly ..... D13/179
10,028,333 B2 * 7/2018 Gu ..... H04W 88/08
2002/0043360 A1 * 4/2002 Lee ..... H01L 23/3677 165/80.3
2002/0176250 A1 * 11/2002 Bohler ..... F21V 19/0005 362/236
2003/0121643 A1 * 7/2003 Connors ..... F28D 15/0233 165/80.3
2004/0190257 A1 9/2004 Chang
2005/0039881 A1 * 2/2005 Reyzin ..... F28D 15/02 165/80.3
2006/0181860 A1 * 8/2006 Larson ..... H01L 23/3677 361/720
2007/0120250 A1 5/2007 Fairchild et al.
2007/0284092 A1 12/2007 Ghosh et al.
2008/0165497 A1 * 7/2008 Gallina ..... H01L 23/367 361/697
2009/0154168 A1 6/2009 Zhang et al.
2009/0321901 A1 12/2009 Lopez et al.
2010/0276118 A1 11/2010 Lin
2011/0279981 A1 * 11/2011 Horng ..... H01L 23/3677 361/720
2012/0044642 A1 2/2012 Rodriguez
2012/0120608 A1 5/2012 Guan
2013/0306291 A1 11/2013 Tung
2013/0343056 A1 12/2013 Wilhelm
2016/0059437 A1 3/2016 Lacy et al.
2016/0069622 A1 * 3/2016 Alexiou ..... G06F 1/1656 165/146
2016/0223183 A1 8/2016 Zou et al.
2016/0245493 A1 8/2016 Eustace et al.
2016/0298913 A1 10/2016 Guo
2017/0191709 A1 7/2017 Chen et al.
2017/0248379 A1 * 8/2017 Kadijk ..... F28F 3/022
2017/0292793 A1 10/2017 Sun et al.

OTHER PUBLICATIONS

Dagan, "Hybrid heat sinks provide optimal cooling for embedded systems", available online at http://www.embedded.com/print/4027004, May 20, 2009, 5 pages.

Enzotech, "Enzotech's Spread Pin Heat Sink Introduction", available online at http://www.enzotechnology.com/spreadpin.htm, Mar. 10, 2012, 3 pages.

Ledcooler, "Round Pin Fin LED Cooler, Cold Forged AL 1070 LED Heatsink", available online at http://ledcooler.blogspot.com/2014/12/round-pin-fin-cooler-forged-heatsink.html, Apr. 12, 2014, 1 page.

(56) References Cited

OTHER PUBLICATIONS

Notice of Allowance for U.S. Appl. No. 29/575,856, dated Jul. 10, 2017, 10 pages.
Notice of Allowance for U.S. Appl. No. 29/575,858, dated Jul. 11, 2017, 11 pages.
Non-Final Office Action for U.S. Appl. No. 29/575,857, dated Jul. 11, 2017, 12 pages.
Extended European Search Report for European Application No. EP 17200163.8, dated Dec. 19, 2017, 7 pages.
Notice of Allowance for U.S. Appl. No. 29/575,857, dated Jan. 5, 2018, 7 pages.
EP 17200163.8, "Office Action," dated Feb. 26, 2019, 5 pages.

* cited by examiner

HEATSINK

FIELD OF THE INVENTION

Embodiments of the present invention relate to heatsinks.

BACKGROUND OF THE INVENTION

Thermal management is of paramount importance in luminaire design. The light sources used in luminaires heat up during use, which can detrimentally impact the efficiency and life expectancy of such light sources. Heatsinks have been incorporated in luminaires to facilitate heat dissipation from the light sources. Such heat dissipation can result both from conduction of heat from the light sources via the heatsink as well as transfer of heat to the air circulating through and around the light sources and heatsink. Such air consequently heats up and rises, thereby carrying heat away from the luminaire via convection.

Luminaires are used in a variety of settings, including outdoor and indoor spaces. To accommodate differences in the arrangement of different sites, luminaires may be configurable or adjustable at the time of mounting so that light from the luminaire may be directed to where it is desired.

SUMMARY OF THE INVENTION

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

Embodiments of the present invention are directed to luminaires, specifically luminaires that can be adjusted to control the direction of light. An adjustable luminaire may be adjusted by tilting and/or rotating of the luminaire. The adjustable luminaire can include a heatsink that is sized and shaped to permit positioning multiple adjustable luminaires in close proximity to one another without the heatsinks of the adjustable luminaires contacting one another or otherwise impeding luminaire adjustment. The size and shape of the heatsink of the adjustable luminaire can be determined based at least in part on the center-to-center distance desired between the heatsinks and the maximum angle of tilt desired for the adjustable luminaires about a selected pivot point.

In some aspects of the invention, the luminaire may be a non-adjustable luminaire. The luminaire may include a heatsink that comprises pin fins extending from a base plate of the heatsink. The pin fins can be bent outwardly towards an outer edge of the base plate of the heatsink such that the tips of the pin fins may extend beyond the base plate of the heatsink. The distance the outer pin fins extend beyond the outer edge of the base plate can correspond to a maximum diameter of the heatsink. The maximum diameter of the heatsink can be greater than the diameter of the base plate of the heatsink.

BRIEF DESCRIPTION OF THE FIGURES

Illustrative embodiments of the present invention are described in detail below with reference to the following drawing figures.

DETAILED DESCRIPTION

Figure 1B:
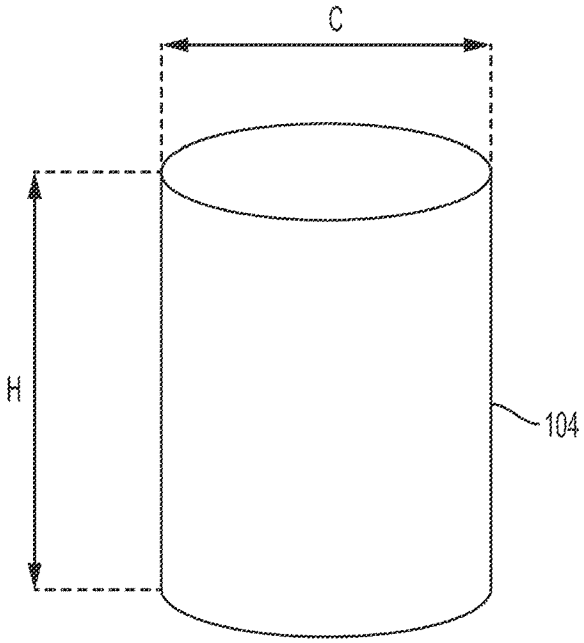
FIG. 1B is a model cylinder depicting the center-to-center distance between two heatsinks, according to embodiments of the present disclosure.
Figure 1A:
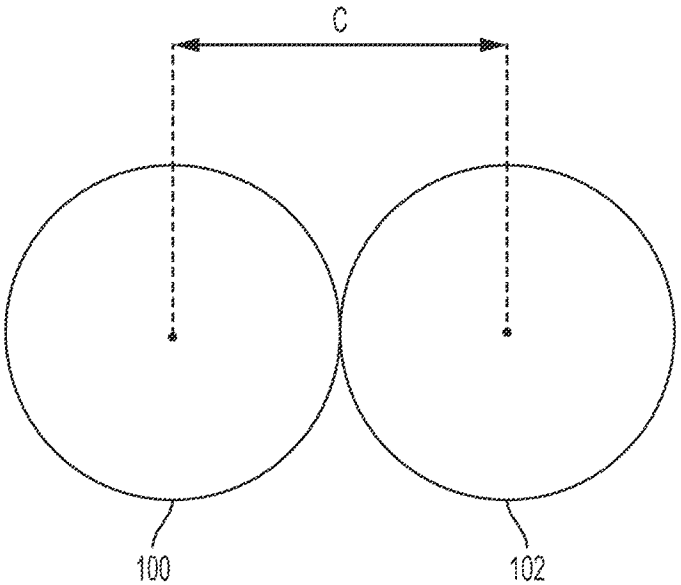
FIG. 1A is a schematic depiction of two heatsinks positioned at a center-to-center distance C, according to embodiments of the present disclosure.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Certain embodiments of the present invention provide a heatsink that is sized and shaped to permit positioning adjustable luminaires in close proximity to one another without the heatsinks interfering with one another during adjustment of the luminaires. The heatsinks of the adjustable luminaires can be sized and shaped to permit clearance of one another during tilting and rotation of the adjustable luminaires. In some embodiments, the size and shape of the heatsink can be determined based on the center-to-center distance between the heatsinks and the maximum desired angle of tilt of the luminaires. The heatsink can comprise continuous fins, pin fins, or a solid material and may be manufactured using cold forging, impact forging, extrusion, casting, machining, sintering, or other suitable manufacturing methods. The heatsink can comprise aluminum, copper, or other suitable materials for conducting heat.

In some embodiments, the heatsinks are formed using an impact forging process. Impact forging is a cold process that starts with a metallic form (e.g., a metal billet) and effectively shapes the form as desired using an impactive force. This is in contrast to die casting whereby molten metal is forced under high pressure into a mold cavity to create the desired shape. With impact forging, the fins may be positioned closer together than with the die casting process so that more fins may be provided on a given heatsink footprint. The fins may be positioned closer together with impact forging at least because impact forging does not require a draft, while die casting requires a draft, which thickens the features of the fin. Additional fins result in more surface area for heat transfer and consequently a heatsink with better thermal management properties. Impact forging also permits the use of 6000 series aluminum (e.g., aluminum 6061: http://asm.matweb.com/search/SpecificMaterial.asp?bassnum=MA6061t6) which is more thermally conductive than other types of aluminum. Such aluminum is not suitable in the traditional die-casting process; for example, aluminum 6061 may be more suited to applications that require heat treatment while aluminum 383, and other traditional casting alloys, are formulated for flowing in molds used for casting.

In certain embodiments, the heatsinks of the adjacent luminaires may be shaped to permit the heatsinks to clear each other during tilting and rotation of the luminaires. In some aspects, the heatsinks of the luminaires can tilt between about 0 degrees and about 60 degrees (measured from an original position, which can be—but does not have to be—the position of the heat sink prior to any tilting of the luminaire) about a pivot point, and may be rotatable up to 365 degrees. As shown in FIGS. 1A-1D, the size and shape parameters of the heatsinks can be dictated in part based on the desired center-to-center spacing C (shown in FIG. 1A) between two adjacent heatsinks 100, 102. In some aspects, more than two heatsinks may be used.

As shown in FIG. 1B, a 3-dimensional model cylinder 104 may have a diameter C, which is equal to the desired center-to-center spacing between the heatsinks 100, 102. The model cylinder 104 may also have a height H. The height H may be essentially infinite in height. FIG. 1C depicts the model cylinder 104 positioned in an original position of the heatsinks 100, 102 during installation, shown in FIG. 1C as a vertical position. In some embodiments, the heatsinks 100, 102 may be in a different original position, for example at a tilt angle of 10 degrees, or any other suitable position. The diameter C and the height H of the model cylinder 104 represent the geometrical constraints on each heatsink 100, 102 at the original position.

A 3-dimensional tilted model cylinder 104' may be mapped over the 3-dimensional model cylinder 104 by positioning the tilted model cylinder 104' at a maximum tilt angle T relative to the original position. The maximum tilt angle T can represent the maximum contemplated angle at which the heatsinks 100, 102 may be tilted in an installation. The tilted model cylinder 104' can be tilted at a pivot point 110, which may be selected based on the installation. The height of the tilted model cylinder 104' and the model cylinder 104 may be essentially infinite and may be determined based on manufacturing capabilities and other desired characteristics of the installation, for example but not limited to the geometric constraints of the heatsinks 100, 102. As shown in FIG. 1C, the tilted model cylinder 104' is therefore positioned at the maximum tilt angle T about the pivot point 110. The tilted model cylinder 104' can represent the geometrical constraints on the size of the heatsinks 100, 102 when they are tilted up to the maximum tilt angle T from their original position (shown in FIG. 1C as vertical).

As shown in FIG. 1C, the shape and size of the heatsinks 100, 102 having a center-to-center distance C (shown in FIG. 1A) and a maximum tilt angle T about a pivot point 110 can be defined by the overlapping regions of the model cylinder 104 and the tilted model cylinder 104' (shown as region 112). Any portion of the model cylinder 104 that does not overlap with the tilted model cylinder 104' (e.g., region 114) is a portion of the heatsinks 100, 102 that would fall outside the geometric bounds of the heatsinks 100, 102. Similarly, any portion of the tilted model cylinder 104' that does not overlap with the model cylinder 104 (e.g., regions 116, 118) also falls outside of the geometric bounds of the heatsinks 100, 102.

Figure 1D:
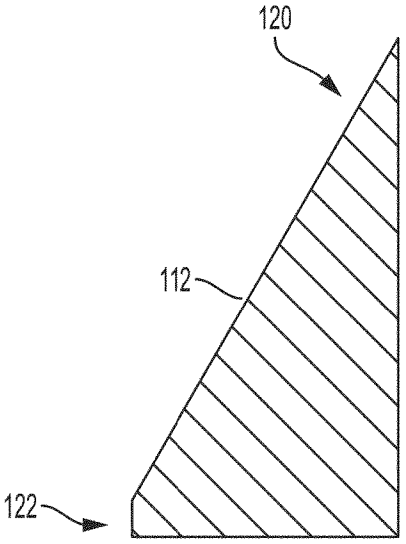
FIG. 1D is a schematic depiction of the geometric boundaries of one embodiment of a heatsink.
Figure 1C:
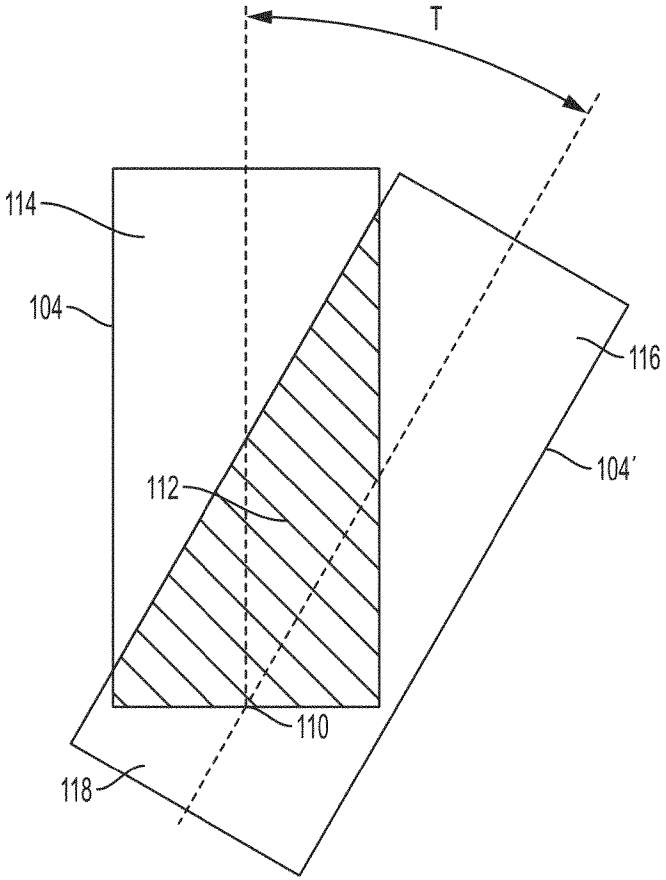
FIG. 1C is a schematic depiction of the model cylinder positioned at an initial angle and the model cylinder positioned at a maximum tilt angle, according to embodiments of present disclosure.

As shown in FIGS. 1C and 1D, the portions of the model cylinder 104 and the tilted model cylinder 104' that overlap one another, shown as region 112, can define the geometric bounds of the heatsinks 100, 102 that permit the heatsinks to be placed at a center-to-center distance C (shown in FIG. 1A) and up to a maximum tilt angle T about a pivot point 110 without the heatsinks 100, 102 interfering with one another during rotation and tilting. Region 112 can include an upper portion 120 which may be narrower than a lower portion 122. The heatsinks 100, 102 may be of any shape or size that falls within the geometric bounds of region 112. The final dimensions (size, shape, etc.) of the heatsinks 100, 102 that fall within the dimensions of the region 112 may be selected based, for example, on a desired amount of surface area for conducting heat away from the luminaire, as well as myriad other factors.

Region 112 is merely an exemplary embodiment and certainly heatsinks contemplated herein are not intended to be limited to sizes and shapes that fall within the particular size and shape of region 112. The actual dimensions of the heatsink selected for the installation can be any dimensions that fit within the geometric boundaries determined as set forth above. In some embodiments, the actual dimensions of the heatsink may be less than the maximum dimensions, while in other embodiments, the actual dimensions of the heatsink may be approximately equal to the maximum dimensions. The actual dimensions of the heatsink may be determined based on the desired level of conductivity of heat for each heatsink, or other features or characteristics of the installation. Moreover, embodiments of the invention are directed to the heatsinks themselves regardless of the methodology used to design the heatsinks. In other words, the methodology explained with respect to FIGS. 1A-1D is not required to be used in the design of the heatsink embodiments disclosed herein.

Figure 2:
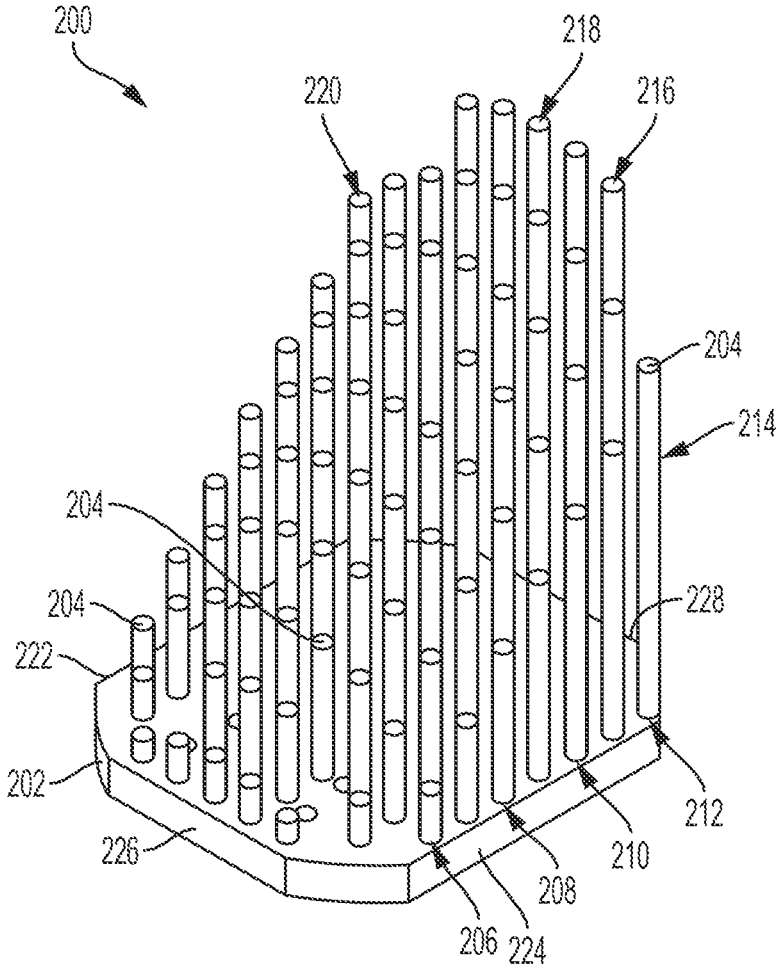
FIG. 2 is a top perspective view of a heatsink that falls within the geometric dimensions depicted in FIG. 1D, according to embodiments of the present disclosure.

FIG. 2 depicts a heatsink 200 that falls within the geometric dimensions of the region 112 (shown in FIG. 1D), according to embodiments of the present disclosure. The heatsink 200 can include a base plate 202 from which multiple fins, for example discrete pin fins 204 extend. In use, the heatsink 200 would be mounted to a luminaire via the base plate 202. The heatsink base plates contemplated herein are not limited to the specific shapes illustrated herein. Rather, they may be of any shape (polygon, rectilinear, oval, round, etc.) within the geometric constraints of the region 112 of FIG. 1D and suitable for attachment to a luminaire.

The pin fins 204 illustrated herein have a circular cross-sectional shape. However, the pin fins 204 may have different shapes (e.g., triangular, square, etc.) and/or be of different sizes. Nor must the size and/or shape of all of the pins on a single heatsink be identical. For example, some pin fins 204 on a heatsink may have a triangular cross-section while others have a circular cross-section. Moreover, some pin fins 204 may have a larger diameter and/or cross-sectional area than other pin fins 204. In some examples, continuous fins and pin fins 204 may both be used.

The pin fins 204 may be provided on the base plate 202 of the heatsink 200 in any orientation. In the illustrated embodiment, the pin fins 204 are oriented on base plate 202 in aligned rows (e.g., rows 206, 208, 210, 212) and columns (e.g., columns 214, 216, 218, 220). However, in other embodiments, the pin fins 204 may be provided in staggered columns and/or rows, radially, or randomly on base plate 202.

In the non-limiting illustrated embodiment, the outer pin fins (e.g., the pin fins proximate to a left side edge 222 or right side edge 224 of the base plate 202) of a particular row may have a shorter height than the pin fins 204 positioned more centrally within the row (i.e., more proximate to the center of the base plate 202). For example, the height of the pin fins 204 within a row may gradually increase moving from both the left side edge 222 and right side edge 224 of the base plate 202 inwardly toward the center of the row (or base plate 202). The pin fins 204 of a row, for example the pin fins 204 of row 206, can each have a height such that the tops of the pin fins 204 within the row collectively define a semi-spherical or arched shape from the left side 222 to the right side 224 of the base plate 202.

Similarly, the height of the pin fins 204 within a column (e.g., columns 214, 216, 218, 220) can also gradually increase from a front 226 of the base plate 202 toward the rear 228 of the base plate. Regardless of whether aligned rows and/or columns are provided, the height of the pin fins 204 moving from opposing left side edge 222 and right side edge 224 of the base plate 202 may gradually increase such that pin fins 204 more centrally located on the heatsink 200 are taller than those located closer to the side edges 222, 244. Similarly, the height of the pin fins 204 moving from the front 226 of the base plate 202 to the rear 228 of the base plate 202 may also gradually increase such that the pin fins 204 proximate to the rear 228 are taller than the pin fins 204 proximate to the front 226. For example, the maximum height of the pin fins 204 of row 206 can be less than the maximum height of the pin fins 204 of row 210. In some aspects, the maximum height of the pin fins 204 of each row can increase from the front 226 of the base plate 202 to the rear 228 of the base plate.

While FIG. 2 shows pin fins 204, in some aspects, continuous fins may be used in addition to or in the place of the discrete pin fins. The continuous fins may be shaped and provided in any suitable manner within the geometric constraints of the region 112 of FIG. 1D.

Figure 3:
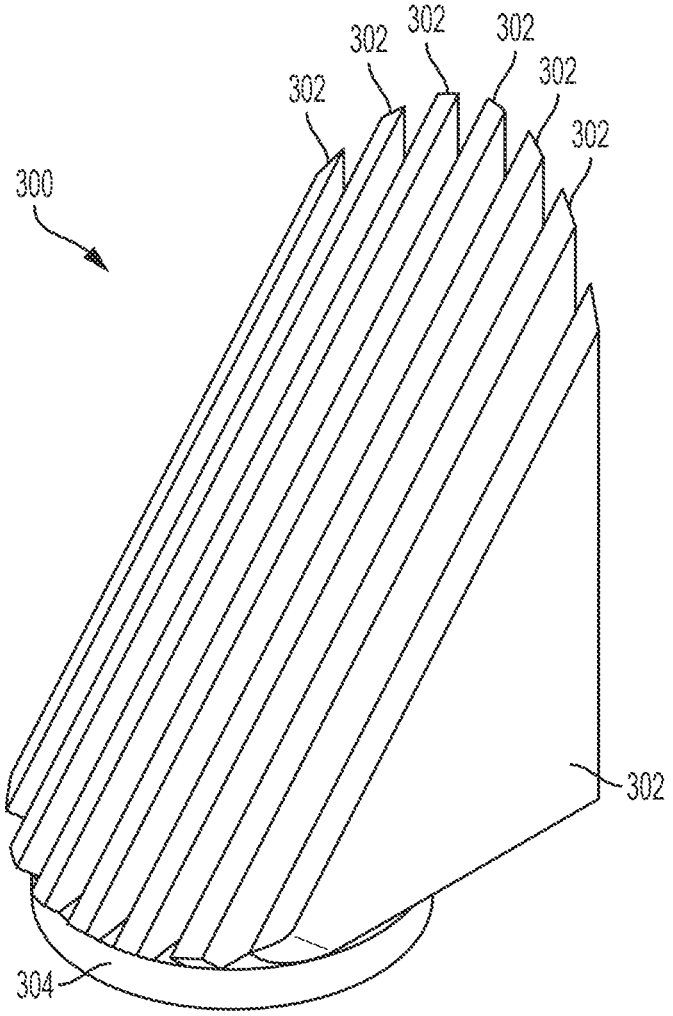
FIG. 3 is a top perspective view of a heatsink that falls within the geometric dimensions depicted in FIG. 1D, according to embodiments of the present disclosure.

FIG. 3 depicts a heatsink 300, which falls within the geometric constraints of the region 112 of FIG. 1D. Heatsink 300 includes multiple continuous fins 302 that extend from base plate 304. As shown in FIG. 3, the continuous fins 302 maintain the same general outline as the columns of pin fins 204 of FIG. 2 (e.g., columns 214, 216, 218, 220) in that the height of each continuous fin 302 increases from a front to a rear of the base plate 304. While FIG. 3 generally depicts continuous fins 302 that maintain the same general outline as the columns of pin fins 204 of FIG. 3, in some embodiments continuous fins may be provided such that they maintain the same general outline as the rows of pin fins 204 of FIG. 2 (e.g., rows 206, 208, 210, 212).

Figure 4:
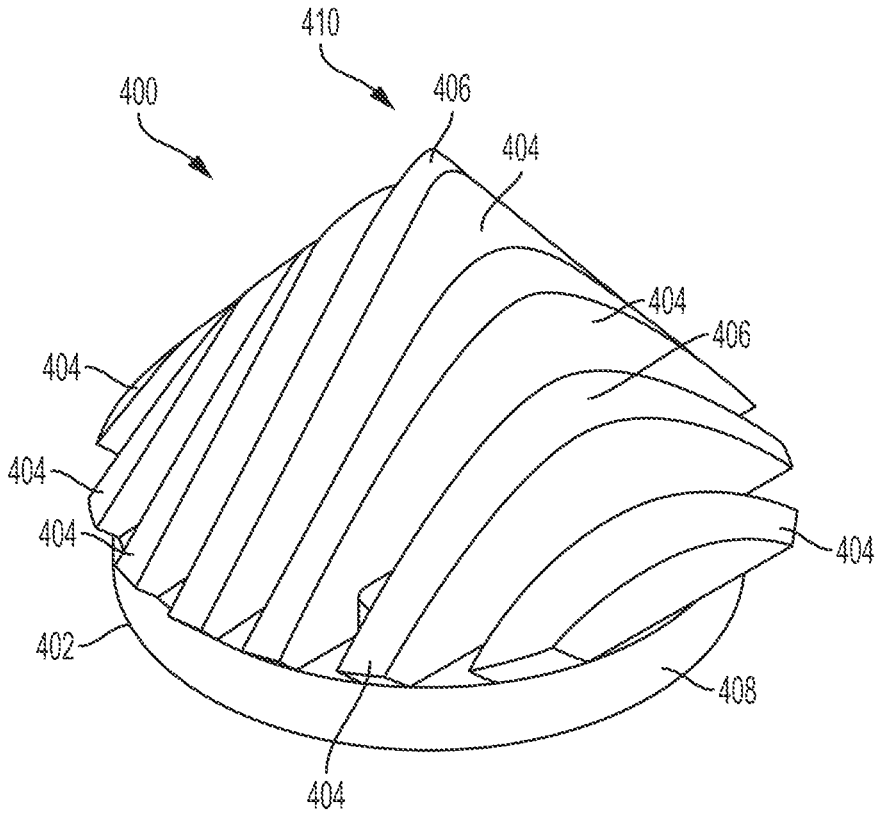
FIG. 4 is a top perspective view of a heatsink that falls within the geometric dimensions depicted in FIG. 1D, according to embodiments of the present disclosure.

FIG. 4 depicts a heatsink 400 which also falls within the geometric constraints of the region 112 of FIG. 1D. The heatsink 400 is generally cone shaped and comprises a base plate 402. The heatsink 400 includes a series of continuous fins 404 which extend vertically upwardly from the base plate 402. The illustrated continuous fins 404 have a generally arched shape such that the height of a continuous fin 404 gradually increases along the length of the continuous fin 404 until it reaches peak 406, after which the fin height gradually decreases. The peak 406 of each continuous fin 404 can be, but does not have to be, near the center point of the continuous fin 404.

The continuous fins 404 can be positioned on base plate 402 such that the height of the peaks 406 increase from one side 408 of the base plate 402 towards the center 410 of the base plate 402. The height of the peaks 406 can then decrease from the center 410 of the base plate 402 towards another side (not shown) of the base plate 402. In other words, the height of the peaks 406 of the continuous fins 404 gradually increases across the base plate 402 and toward the center 410 of the base plate 402, after which the height of the peaks 406 gradually decrease.

Figure 5:
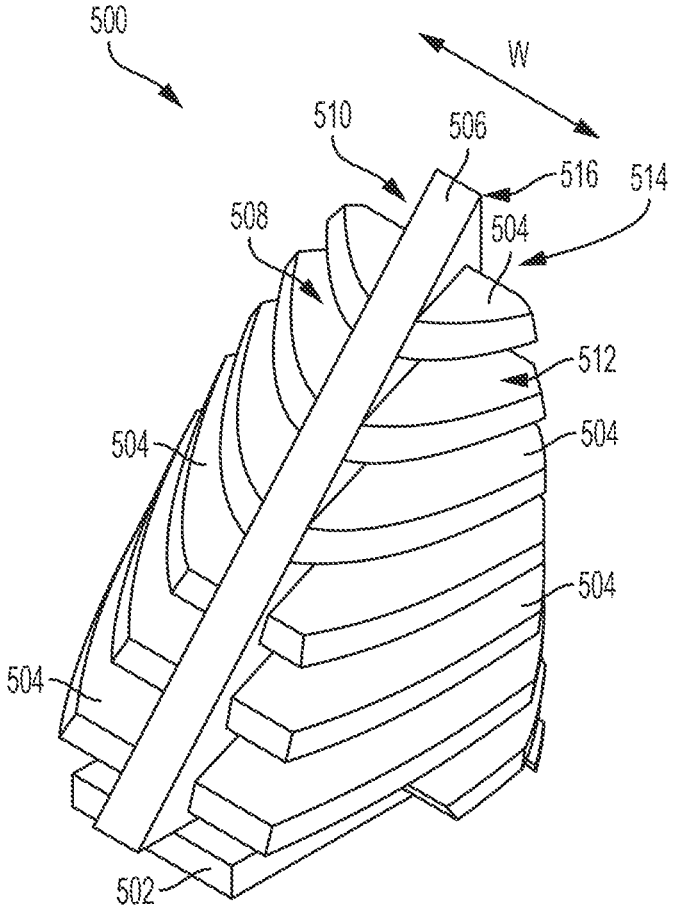
FIG. 5 is a top perspective view of a heatsink that falls within the geometric dimensions depicted in FIG. 1D, according to embodiments of the present disclosure.

FIG. 5 depicts a heatsink 500 which also falls within the geometric constraints of the region 112 of FIG. 1D. The heatsink 500 includes a base plate 502 and fins 504. The fins 504 may be positioned horizontally relative to base plate 502 (i.e., fins 504 and base plate 502 lie in parallel planes) and extend from a central fin 506. The central fin 506 may extend vertically upwardly from the base plate 502 and may have a generally triangular shape. Each of the fins 504 includes a first portion 508 extending from a first side 510 of the central fin 506 and a second portion 512 extending from a second side 514 of the central fin 506 such that the first and second portions 508, 512 collectively define a width W of each fin 504. The width W of the fins 504 proximate to the base plate 502 of the heatsink 500 may be greater than the width W of the fins 504 proximate to a top 516 of the central fin 506. One or more of the fins 504 may be generally u-shaped, as shown in FIG. 5. The shape and size of the fins 504 and the central fin 506 may be determined based on the geometric constraints of the region 112 of FIG. 1D. Thus, the size and shape of the fins 504 may be smaller near the top 516 of the central fin 506 than those fins 504 near the base plate 502, where the top 516 of the central fin 506 corresponds to the upper portion 120 of the region 112, and the base plate 502 of the heatsink 500 corresponds to the lower portion 122 of the region 112 of FIG. 1D.

In some embodiments, heatsinks are provided with a combination of pin fins and continuous fins. Moreover, in some embodiments, the heatsink may be provided as a solid material devoid of pin fins or continuous fins, provided the heatsink falls within the geometric constraints of the region 112 of FIG. 1D.

Figure 6:
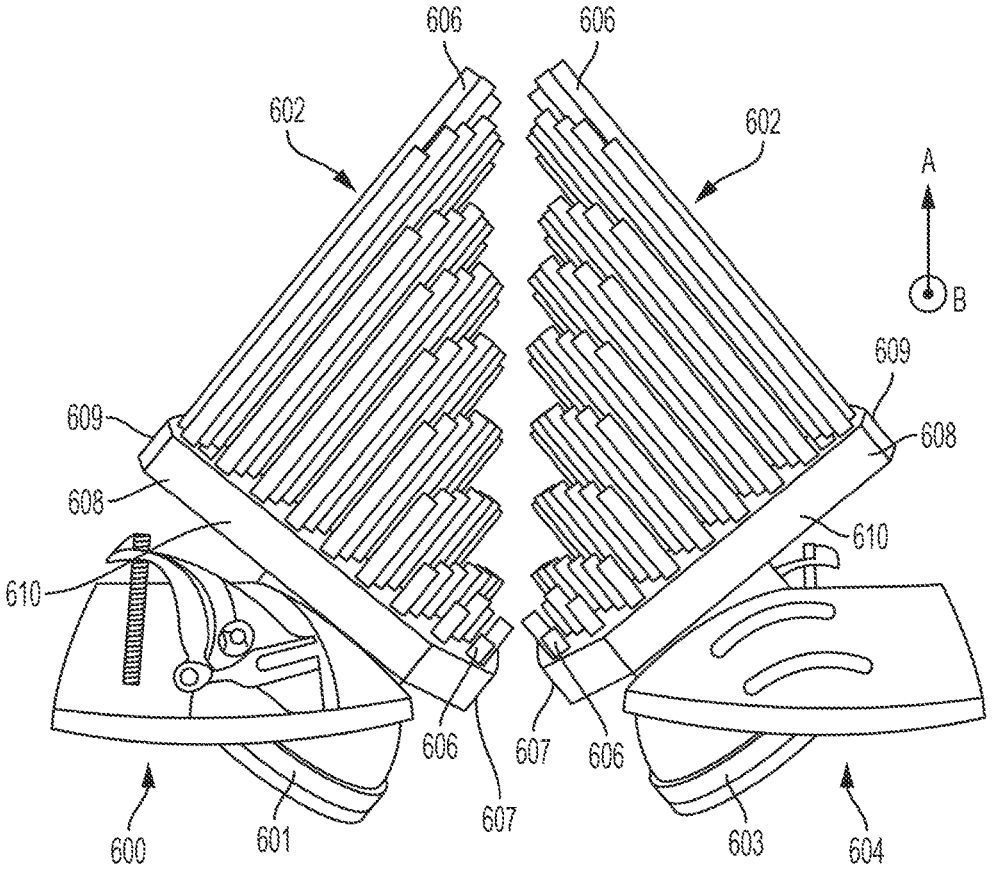
FIG. 6 is a perspective view of two luminaires having heatsinks according to embodiments of the present disclosure.

FIG. 6 shows a first luminaire 600 (which includes a light engine 601 onto which heatsink 602 is attached) and a second luminaire 604 (which also includes light engine 603 and heatsink 602), where the heatsinks 602 are positioned at the desired center-to-center spacing C from each other. The heatsinks 602 are generally sized and shaped as shown in the depiction of the heatsink 200 of FIG. 2. Each of the heatsinks 602 includes pin fins 606 extending from a base plate 608. As shown in FIG. 6, the shape of the pin fins 606 and the base plate 608 of the heatsinks 602 allow the luminaires 600, 604 to be rotated about an axis A (which in this embodiment extends substantially perpendicular through the luminaires 600, 604) and tilted about an axis B (which in this embodiment extends substantially perpendicular to axis A and about a desired pivot point) without the heatsinks 602 interfering with one another. The difference in the height of the pin fins 606 from a front 607 of the base plate 608 towards a rear 609 of the base plate 698 allows the luminaires 600, 604 to be tilted up to the maximum tilt angle T (see FIG. 1C) such that the light engines 601, 603 are tilted away from one another while the respective heatsinks 602 are tilted towards one another, without the heatsinks 602 contacting each other. Thus, the luminaires 600, 604 are able to tilt freely by ensuring their respective heatsinks 602 clear one another during tilting.

Figure 7:
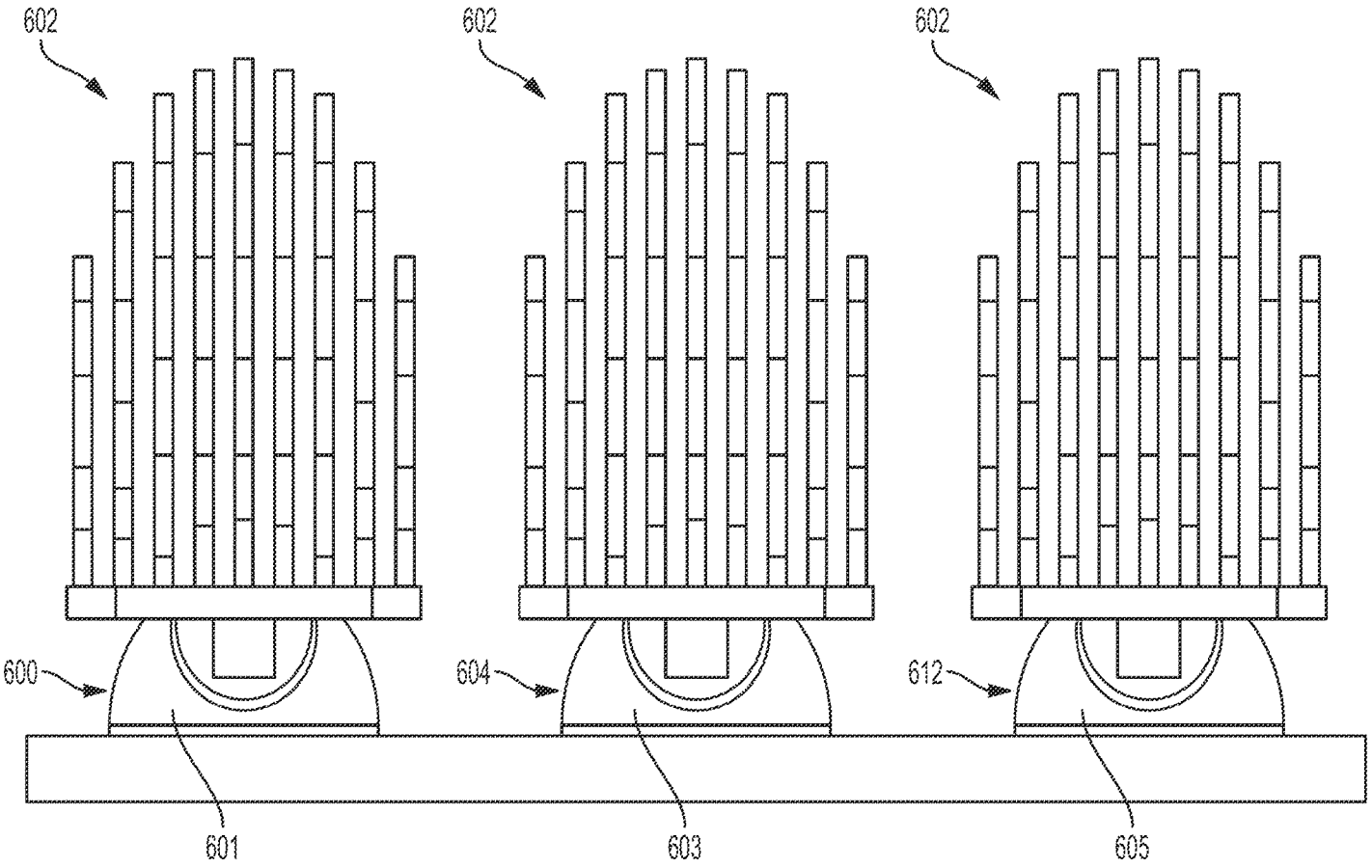
FIG. 7 is a side view of three luminaires having heatsinks according to embodiments of the present disclosure.

In some embodiments, the luminaires 600, 604 may rotate about axis A (potentially up to 360 degrees) even when the heatsinks 602 are oriented at the maximum desired tilt angle without the heatsinks 602 interfering with one another because of the difference in height of the pin fins 606 from an outer edge 610 of the base plate 608 toward a center of the base plate 608. Thus, the height and position of the pin fins 606 of the heatsinks 602 allow the luminaires 600, 604 to tilt and rotate as desired when positioned the desired center-to-center spacing C from each other because the heatsinks 602 are designed to clear one another regardless of the position of the luminaires 600, 604 when so spaced. This is in contrast to typical heatsink designs that are not similarly dimensioned for clearance such that the luminaires on which they are provided must be spaced further apart from each other to be able to tilt and rotate relative to each other. In some aspects, as shown in FIG. 7, additional luminaires, for example third luminaire 612 having a light engine 605 and heatsink 602, can be positioned adjacent one another without the heatsinks 602 of the luminaires 600, 604, 612 contacting one another during the rotation and tilting of the luminaires 600, 604, 612. In some embodiments, multiple luminaires having heatsinks with geometric dimensions determined as shown in FIG. 1 can be positioned in other arrangements relative to one another, for example to form a hexagon, in a two-by-two arrangement, in a three-by-three arrangement, or other desired arrangements.

Figure 8:
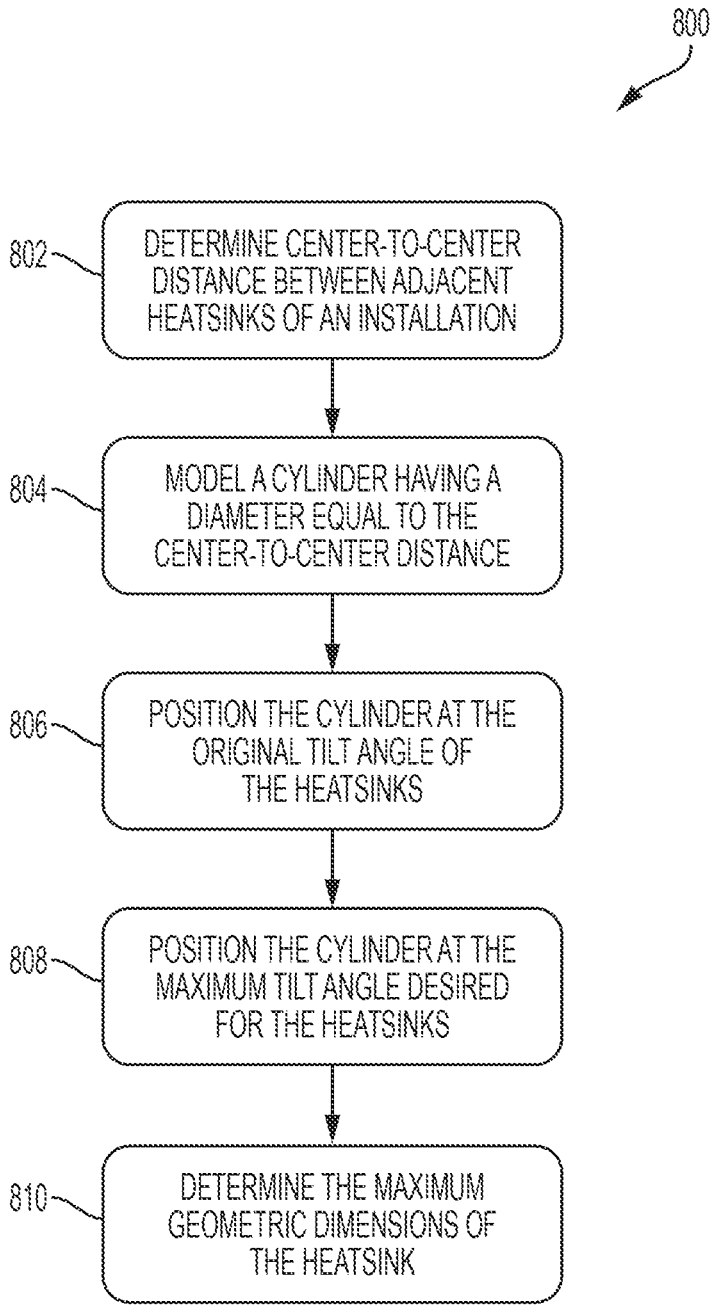
FIG. 8 depicts a method of determining the geometric dimensions of a heatsink, according to embodiments of the present disclosure.

A method 800 of determining the geometric dimensions of a heatsink according to an embodiment of the present disclosure is shown in FIG. 8. At block 802 the desired center-to-center distance between adjacent heatsinks of a luminaire installation can be determined. The center-to-center distance desired may depend on the location of the installation, the lighting angle desired, the size of the luminaires to be installed, the number of luminaires in the installation, the position of the luminaires relative to one another in the installation, and/or other features and characteristics of the installation.

At block 804, a 3-dimensional model cylinder having a diameter equal to the center-to-center distance of the adjacent heatsinks of the installation is created. The model may be created using a computing device, for example the computing device of FIG. 9. The computing device may include a processing device that can execute one or more operations for performing the method described in FIG. 8. In some embodiments, a physical model may be made.

At block 806, the 3-dimensional model cylinder can be positioned at the original tilt angle of the heatsinks. For example, the heatsinks in the installation may be positioned at an original tilt angle that is about 0 degrees off zenith. In some embodiments, the heatsinks may have a starting tilt angle that is more than 0 degrees off zenith, for example, but not limited to, 45 degrees.

At block 808 the 3-dimensional model cylinder is positioned at the maximum tilt angle desired for the heatsinks in the installation. The model cylinder is rotated about a desired pivot point. The desired pivot point can be determined based on the features and/or characteristics of the particular installation.

The maximum geometric dimensions of the heatsink can be determined at block 810. The maximum geometric dimensions of the heatsink can be determined by calculating the geometric dimensions or boundaries of where the 3-dimensional model cylinder at the original tilt angle and the 3-dimensional model cylinder at in the maximum tilt angle overlap one another. The geometric dimensions defined by the regions where the model cylinder at the original tilt angle and the model cylinder at the maximum tilt angle overlap correspond to the maximum geometric dimensions or boundaries of the heatsink that ensure a heatsink that fits within such dimensions will not interfere with an adjacent heatsink (that also fits within such dimensions), positioned at the desired center-to-center distance and at the desired tilt angle up to the maximum tilt angle.

Figure 9:
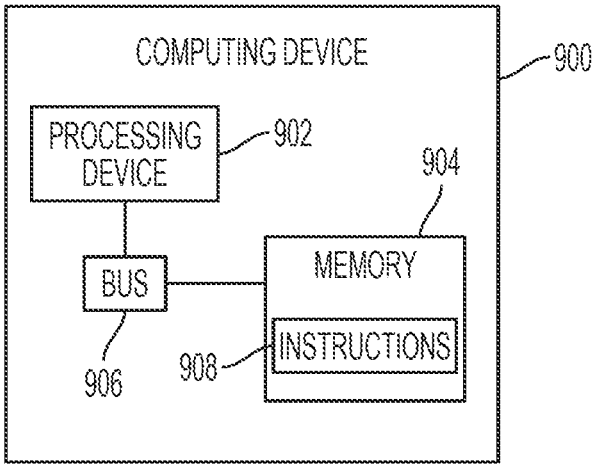
FIG. 9 is a block diagram depicting an example of a computing device for performing the method of FIG. 8.

FIG. 9 is a block diagram depicting an example of a computing device 900 according to one aspect of the present disclosure. The computing device 900 may include one or more of a processing device 902, a memory device 904, and a bus 906. The processing device 902 can execute one or more operations for determining the geometric dimensions of a heatsink, for example but not limited by performing the method 800 described above. The processing device 902 can execute instructions 908 stored in the memory device 904 to perform the operations. The processing device 902 can include one processing device or multiple processing devices. Non-limiting examples of the processing device 902 include a Field-Programmable Gate Array ("FPGA"), an application-specific integrated circuit ("ASIC"), a microprocessor, etc.

The processing device 902 can be communicatively coupled to the memory device 904 via the bus 906. The memory device 904 may include any type of memory device that retains stored information when powered off. Non-limiting examples of the memory device 904 include EEPROM, flash memory, or any other type of non-volatile memory. In some aspects, at least some of the memory device 904 can include a medium from which the processing device 902 can read the instructions 908. A computer-readable medium can include electronic, optical, magnetic, or other storage devices capable of providing the processing device 902 with computer-readable instructions or other program code. Non-limiting examples of a computer-readable medium include (but are not limited to) magnetic disk(s), memory chip(s), ROM, RAM, an ASIC, a configured processor, optical storage, or any other medium from which a computer processor can read instructions. The instructions may include processor-specific instructions generated by a compiler or an interpreter from code written in any suitable computer-programming language, including, for example, C, C++, C#, etc.

Some embodiments of the present invention provide a heatsink that comprises pin fins provided on a base plate of the heatsink. The pin fins can be angled outwardly from a center of the base plate such that the tips of some of the fins extend beyond an outer edge of the base plate. In some embodiments of the invention, the pin fins positioned closer to the outer edge of the base plate can be shorter than the pin fins positioned closer to the center of the base plate. The shorter length of the outer pin fins can permit cooler air to reach the pin fins proximate to the center of the base plate by reducing the number of pin fins the air has to pass through before reaching the center of the base plate. The conduction of heat away from the center of the base plate of the heatsink can be improved by cooler air reaching the pin fins proximate to the center of the base plate.

Figure 10:
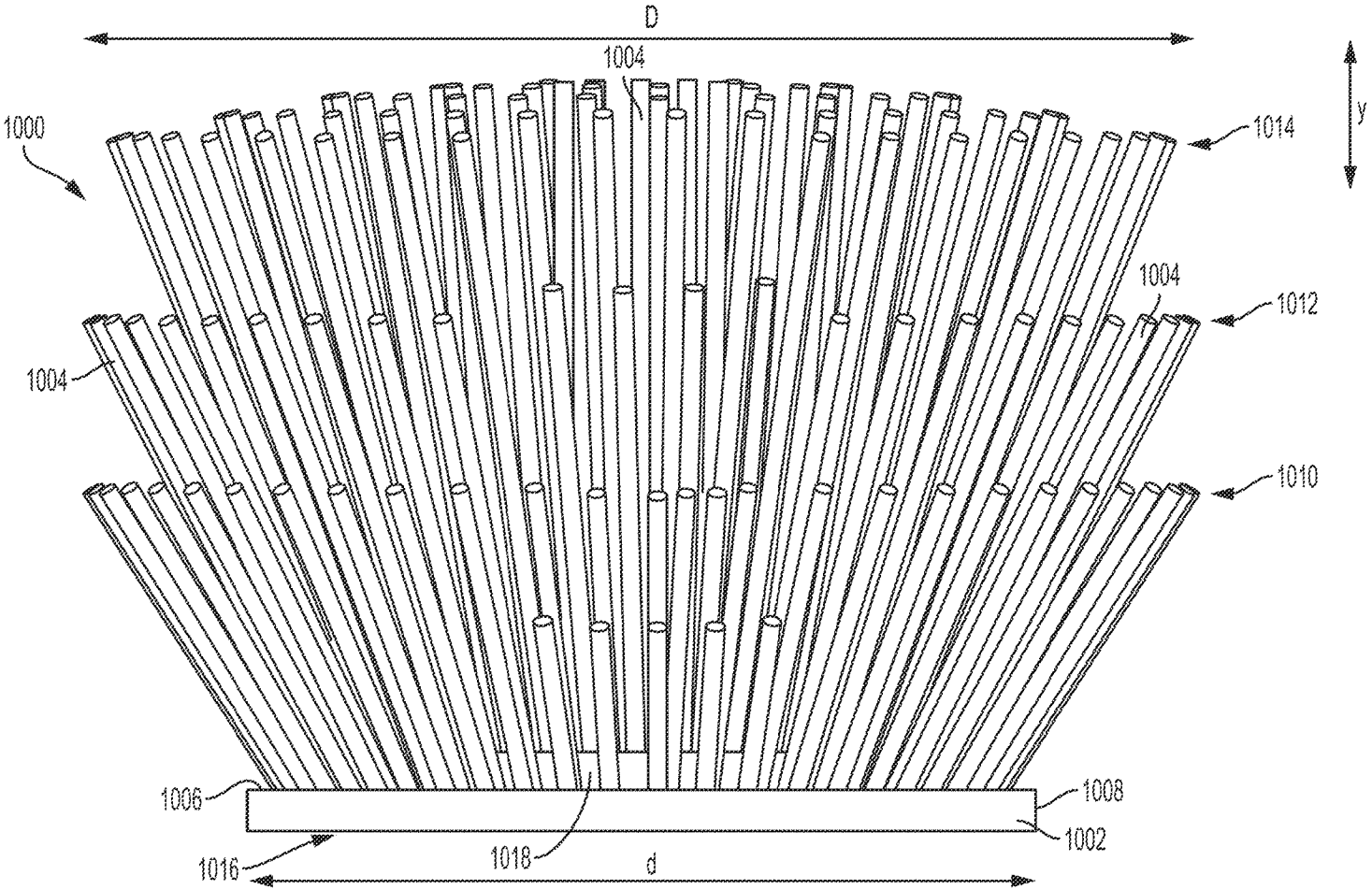
FIG. 10 is a side view of a heatsink, according to embodiments of the present disclosure.

FIG. 10 depicts a heatsink 1000 according to such an embodiment. The heatsink 1000 includes a base plate 1002 and a plurality of pin fins 1004 extending upwardly from, and at an angle relative to, the base plate 1002 (and more specifically in some embodiments, the top surface 1006 of the base plate 1002). As described above, the pin fins 1004 can be of different shapes and/or sizes than as shown in FIG. 10.

Figure 11:
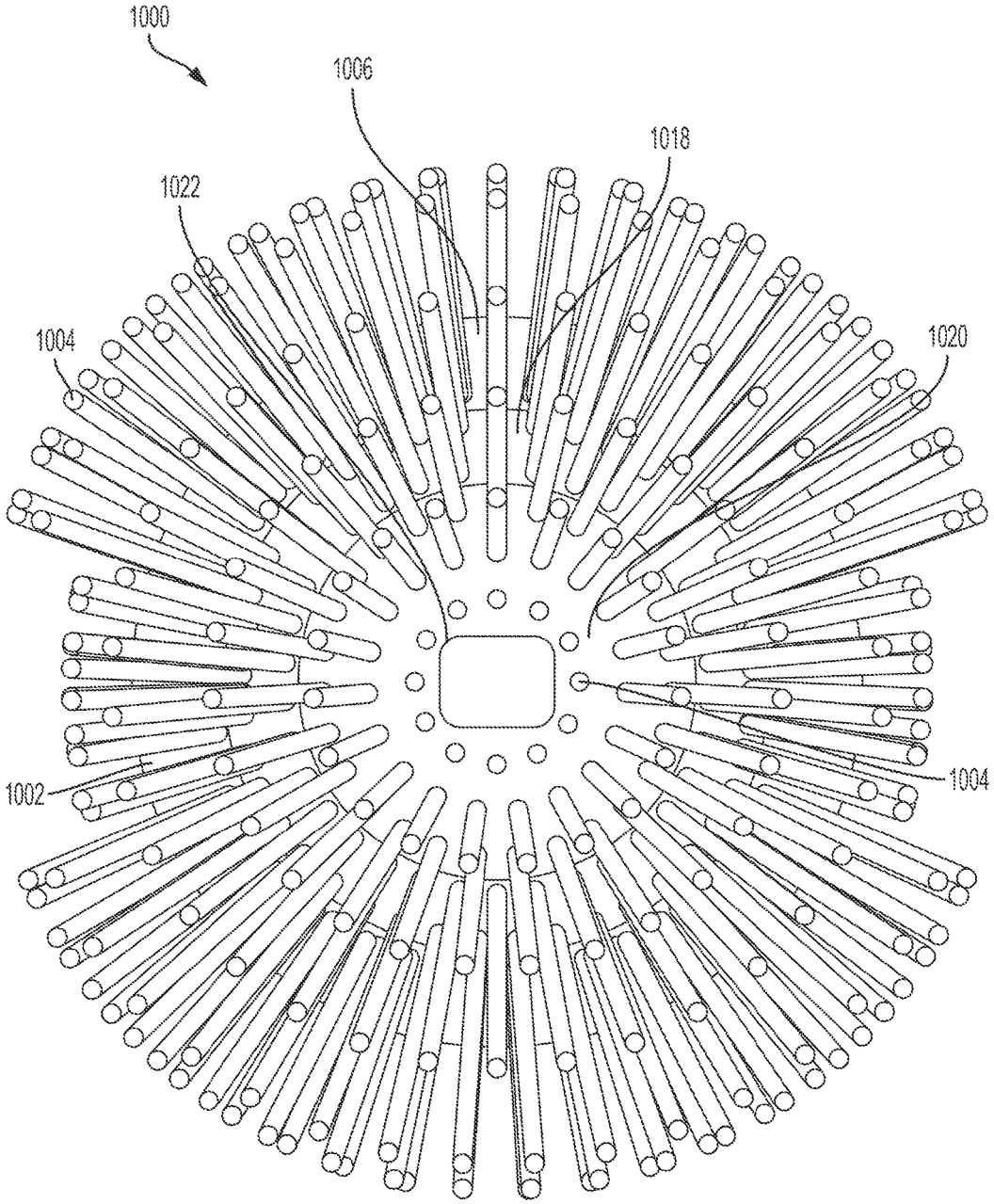
FIG. 11 is a top view of the heatsink of FIG. 10, according to embodiments of the present disclosure.
Figure 12:
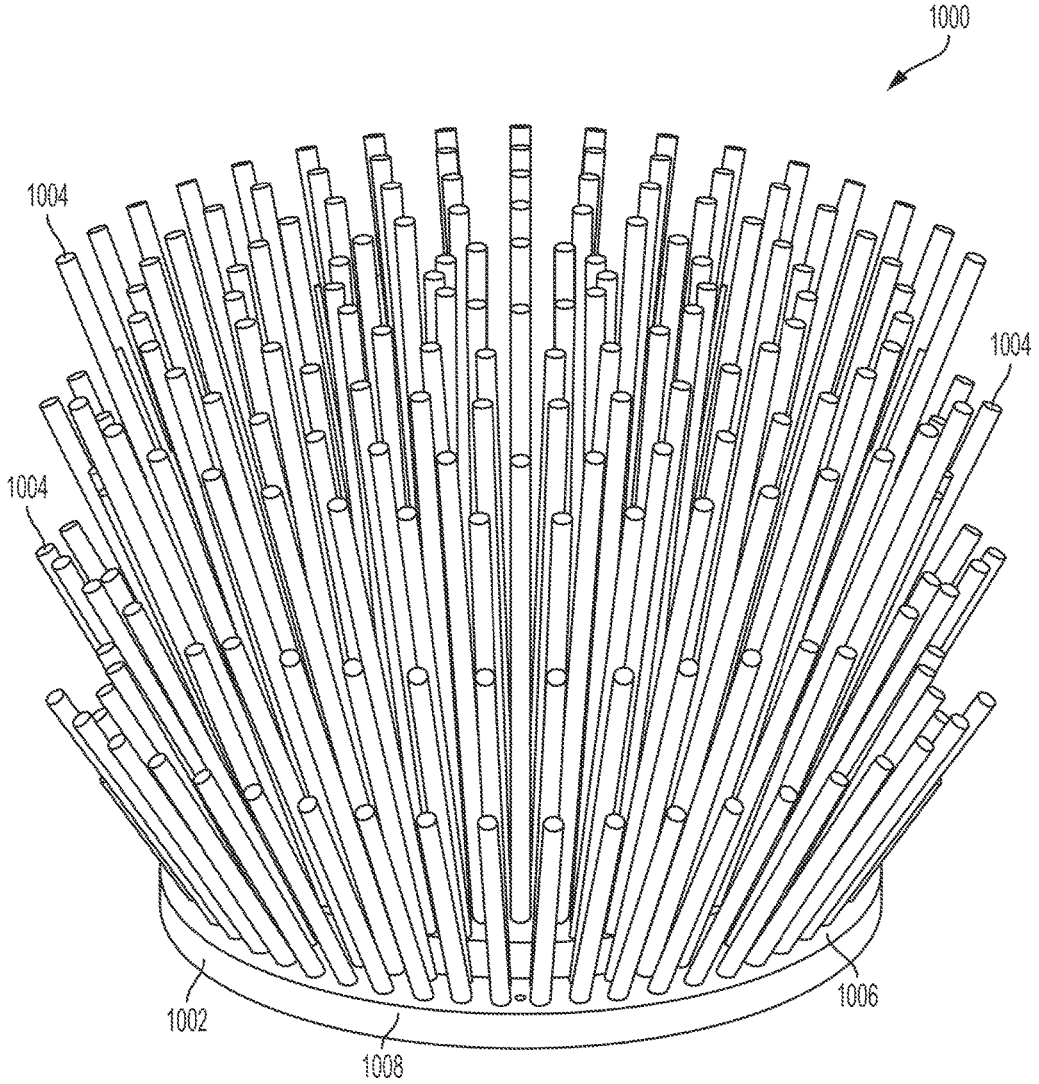
FIG. 12 is a perspective view of the heatsink of FIG. 10, according to embodiments of the present disclosure.

While the pin fins 1004 can extend upwardly from the base plate 1002 at an approximate angle of 90 degrees relative to the base plate 1002, in some embodiments some or all of the pin fins 1004 are oriented at an angle less than 90 degrees. The desired angle of the pin fins 1004 can be determined based on the desired characteristics of the installation. In some aspects, the air speed velocity through the pin fins 1004 can be measured as well as the temperature at various parts of the luminaire. In some aspects these measurements can be used to determine the desired angle of the pin fins 1004. The pin fins 1004 need not all be oriented at the same angle. For example, FIGS. 11 and 12 shows pin fins 1004 more centrally located on the base plate 1002 (such as within upper pin fin tier 1014, discussed below) extending substantially at 90 degrees relative to the base plate 1002 while the pin fins 1004 located closer to an outer edge 1008 of the base plate 1002 extend at a smaller angle relative to the base plate 1002. By angling the pin fins 1004, some of the pin fins 1004 extend beyond the outer edge 1008 of the base plate 1002. As shown in FIG. 10, the base plate 1002 of the heatsink 1000 can have a diameter d that is less than the overall diameter D of the heatsink 1000.

In some aspects, the pin fins 1004 are provided in pin fin tiers, for example a lower pin fin tier 1010, a middle pin fin tier 1012, and an upper pin fin tier 1014, though any number of pin fin tiers may be provided. As shown in FIG. 10, the pin fins 1004 within the lower pin fin tier 1010 extend above the base plate 1002 less than the pin fins 1004 within the middle pin fin tier 1012 or upper pin fin tier 1014. Similarly, the pin fins 1004 within the middle pin fin tier 1012 extend above the base plate 1002 less than the pin fins 1004 within the upper pin fin tier 1014. In other words, the pin fins 1004 within the upper pin fin tier 1014 extend beyond the tips of the pin fins 1004 of the lower and middle pin fin tiers 1010, 1012 such that air coming in from the side of the heatsink 1000 may reach the pin fins 1004 within the upper pin fin tier 1014 directly without having first to pass through the pin fins 1004 that extend from the lower and middle pin fin tiers 1010, 1012. Similarly, the pin fins 1004 within the middle pin fin tier 1012 extend beyond the tips of the pin fins 1004 of the lower pin fin tier 1010 such that air coming in from the side of the heatsink 1000 may reach the pin fins 1004 within the middle pin fin tier 1012 directly without having first to pass through the pin fins 1004 that extend from the lower pin fin tier 1010. Moreover, the air need only pass through the pin fins 1004 of the middle pin fin tier 1012 before reaching portions of the pin fins 1004 of the upper pin fin tier 1014.

When the heatsink 1000 is attached to an LED light engine (such as via attachment of the LED light engine to a lower surface 1016 of base plate 1002), it is more difficult to dissipate the heat generated by the LEDs located more centrally within the light engine and thus a hot spot forms at the center of light engine. It is therefore critical that air be able to reach the center of the heatsink 1000 so as to carry the excessive heat away via convection. The air heats and rises upwardly through the heatsink 1000, carrying away heat that otherwise would remain in the central portion of the heatsink 1000 where it would degrade the LEDs and detrimentally impact their useful life. The heatsink design of FIGS. 10-12 enhances the efficiency of the heatsink 1000 because it enables air to reach the center of the heatsink 1000 more easily, bypassing some of the pin fins 1004 that would otherwise impede air flow to the center of the heatsink 1000.

In some embodiments, the pin fins 1004 all extend directly from the base plate 1002, and the desired pin fin height configuration (e.g., pin fin tiers) is achieved by varying the height of the pin fins 1004. By way only of example, all of the pin fins 1004 may extend from the base plate 1002 and be formed to create the various pin fin tiers 1010, 1012, 1014 shown in FIG. 10. However, in other embodiments, the base plate 1002 includes one or more raised tiers or surfaces from which the pin fins 1004 may extend. For example, as shown in FIG. 11, two raised tiers 1018, 1020 are each concentric circles formed or otherwise provided on the base plate 1002. Pin fins 1004 of the lower pin fin tier 1010 extend from the top surface 1006 of the base plate 1002, pin fins 1004 of the middle pin fin tier 1012 extend from raised tier 1018, and pin fins 1004 of the upper pin fin tier 1014 extend from raised tier 1020. The raised tiers 1018, 1020 may be of any size or shape and may be the same or different shapes. In some aspects, the raised tiers 1018, 1020 could be oval, triangular, square, or other suitable shape or shapes. Any number of raised tiers may be used. The raised tiers may be formed integrally with base 1002 or could be separate components that are mounted on base 1002 using any mechanical or chemical mounting means, including, but not limited to, fasteners, adhesives, snap-fit engagement, etc.

While FIG. 10 illustrates a plurality of pin fin tier configuration, such a configuration is not required. Rather, a single tier of pin fins 1004 may be provided. The single tier of pin fins 1004 may extend from the base plate 1002. The single tier of pin fins 1004 may extend to a consistent height above the base plate 1002. The tips of the fin pins 1004 that comprise the single tier of pin fins 1004 may define a top of the heatsink 1000.

Regardless of whether raised tiers 1018, 1020 are used, the heatsink 1000 may be formed by initially forming the heatsink with the pin fins 1004 at the desired height and at the desired angular orientation relative to the base plate 1002. Alternatively, the pin fins 1004 may initially all be formed to extend perpendicular to the base plate 1002 and subsequently and selectively angled outwardly to the desired angle(s) to thereby open up the heatsink structure. Moreover, all of the pin fins 1004 can be formed of the same height and some or all of the pin fins 1004 subsequently cut to achieve the desired fin configuration.

In some embodiments, the ends of the pin fins 1004 (particularly the pin fins 1004 oriented at smaller angle(s) relative to the base plate 1002 and located more proximate the outer edge 1008 of the base plate 1002) may be cut such that the pin fins 1004 do not extend beyond an overall or maximum diameter D of the heatsink 1000. The maximum diameter D of the heatsink 1000 can be selected based on the characteristics of the lighting installation in which the heatsink 1000 will be used. For example, if the heatsink 1000 is for use with a recessed luminaire such that it will be recessed within a ceiling, the maximum diameter D of the heatsink 1000 is defined so as not to exceed the diameter of the opening in the ceiling through which the heatsink 1000 must pass. The maximum diameter D can also be impacted by the conduction requirements of the installation, the size of the installation, the size of the luminaires of the installation, and other features of the installation. As shown in FIG. 11, the base plate 1002 may have a cutout or an opening 1022 to permit wiring to pass through the heatsink 1000 and reach the light engine (not shown) to which the heatsink 1000 (specifically lower surface 1016) is attached.

The foregoing is provided for purposes of illustrating, explaining, and describing embodiments of the present invention. Further modifications and adaptations to these embodiments will be apparent to those skilled in the art and may be made without departing from the scope or spirit of the invention. Different arrangements of the components depicted in the drawings or described above as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

What is claimed is:

1. A heatsink comprising:

a base plate comprising a planar upper surface, at least one outer edge and a central region;

a first pin fin tier comprising a first plurality of pin fins each having a fin length and extending upwardly from the planar upper surface of the base plate at a first constant acute angle relative to the planar upper surface, wherein each of the first plurality of pin fins is straight along the entirety of the fin length and at least some of the first plurality of pin fins of the first pin fin tier have distal tips that extend to a first maximum height measured from the planar upper surface of the base plate;

a second pin fin tier comprising a second plurality of pin fins each having a fin length and extending upwardly from the base plate at a second constant acute angle relative to the planar upper surface, wherein each of the second plurality of pin fins is straight along the entirety of the fin length and at least some of the second plurality of pin fins of the second pin fin tier have distal tips that extend to a second maximum height measured from the planar upper surface of the base plate, wherein the second maximum height is greater than the first maximum height such that an upper portion of the second plurality of pin fins extends above an upper portion of the first plurality of pin fins and a fluid can enter the heatsink along a flow path orthogonal to the planar upper surface to encounter the upper portion of the second plurality of pin fins without passing through the first plurality of pin fins, wherein at least some of the first plurality of pin fins of the first pin fin tier are angled toward the at least one outer edge of the base plate and extend beyond the at least one outer edge of the base plate, and wherein the second pin fin tier is located more proximate the central region of the base plate than the first pin fin tier.

2. The heatsink of claim 1, further comprising a third pin fin tier comprising a third plurality of pin fins each having a fin length and extending upwardly from the base plate at a constant angle relative to the planar upper surface of the base plate, wherein each of the third plurality of pin fins is straight along the entirety of the fin length and at least some of the third plurality of pin fins of the third pin fin tier have distal tips that extend to a third maximum height measured from the planar upper surface of the base plate, wherein the third maximum height is greater than the second maximum height such that an upper portion of the third plurality of pin fins extends above the upper portion of the second plurality of pin fins and a fluid can enter the heatsink along a flow path orthogonal to the planar upper surface to encounter the upper portion of the third plurality of pin fins without passing through the second plurality of pin fins.

3. The heatsink of claim 1, wherein the base plate further comprises at least one raised surface extending above the planar upper surface, wherein at least some of the second plurality of pin fins extend from the at least one raised surface.

4. The heatsink of claim 1, wherein the first constant acute angle is less than the second constant acute angle.

5. The heatsink of claim 1, wherein the first plurality of pin fins comprise aluminum.

6. The heatsink of claim 1, wherein the first plurality of pin fins are formed by casting.

7. The heatsink of claim 3, wherein at least some of the third plurality of pin fins extend perpendicular relative to the planar upper surface of the base plate.

8. The heatsink of claim 1, wherein a thickness of the base plate is greater at the central region than at the at least one outer edge.

9. A heatsink comprising:

a base plate comprising a planar upper surface, at least one outer edge and a central region;

a first plurality of pin fins, each pin fin having a fin length and extending upwardly from the planar upper surface of the base plate at a first constant acute angle relative to the planar upper surface, wherein each of the first plurality of pin fins is straight along the entirety of the fin length and at least some of the pin fins of the first plurality of pin fins have distal tips that extend to a first maximum height measured from the planar upper surface of the base plate; and a second plurality of pin fins, each pin fin having a fin length and extending upwardly from the base plate at a second constant acute angle relative to the planar upper surface, wherein each of the second plurality of pin fins is straight along the entirety of the fin length and at least some of the pin fins of the second plurality of pin fins have distal tips that extend to a second maximum height measured from the planar upper surface of the base plate, the second maximum height being greater than the first maximum height, wherein the second plurality of pin fins are positioned closer to the central region of the base plate than the first plurality of pin fins such that an upper portion of the second plurality of pin fins extends above an upper portion of the first plurality of pin fins and a fluid can enter the heatsink along a flow path orthogonal to the planar upper surface to encounter the upper portion of the second plurality of pin fins without passing through the first plurality of pin fins, and wherein at least some of the pin fins of the first plurality of pin fins are angled toward the at least one outer edge of the base plate and extend beyond the at least one outer edge of the base plate.

10. The heatsink of claim 9, further comprising a third plurality of pin fins each pin fin having a fin length and extending upwardly from the base plate at a constant angle relative to the planar upper surface, wherein each of the third plurality of pin fins is straight along the entirety of the fin length and at least some of the pin fins of the third plurality of pin fins have distal tips that extend to a third maximum height measured from the planar upper surface of the base plate, the third maximum height being greater than the second maximum height such that an upper portion of the third plurality of pin fins extends above an upper portion of the second plurality of pin fins and a fluid can enter the heatsink along a flow path orthogonal to the planar upper surface to encounter the upper portion of the third plurality of pin fins without passing through the second plurality of pin fins.

11. The heatsink of claim 9, wherein the base plate further comprises a raised surface.

12. The heatsink of claim 11, wherein the second plurality of pin fins extends from the raised surface of the base plate.

13. The heatsink of claim 9, wherein the pin fins of the first plurality of pin fins comprise aluminum.

14. The heatsink of claim 9, wherein the first constant acute angle is less than the second constant acute angle.

15. The heatsink of claim 10, wherein at least some of the third plurality of pin fins extend perpendicular relative to the planar upper surface of the base plate.

16. The heatsink of claim 9, wherein a thickness of the base plate is greater proximate the central region of the base plate than proximate the at least one outer edge of the base plate.

* * * * *